US008693294B1

(12) United States Patent
Tucker

(10) Patent No.: US 8,693,294 B1
(45) Date of Patent: Apr. 8, 2014

(54) VIBRATORY ALARM ASSEMBLY

(76) Inventor: Robert J. Tucker, Charlotte, NC (US)

( * ) Notice: Subject to any disclaimer, the term of this patent is extended or adjusted under 35 U.S.C. 154(b) by 70 days.

(21) Appl. No.: 13/557,982

(22) Filed: Jul. 25, 2012

(51) Int. Cl.
*G04C 21/00* (2006.01)

(52) U.S. Cl.
USPC ..... 368/250; 368/278

(58) Field of Classification Search
USPC ..... 368/244, 250, 278; 340/7.6, 7.63
See application file for complete search history.

(56) References Cited

U.S. PATENT DOCUMENTS

| | | | | |
|---|---|---|---|---|
| 2,923,122 | A * | 2/1960 | Inman | 368/12 |
| 5,072,429 | A * | 12/1991 | Mair | 368/10 |
| 5,144,600 | A | 9/1992 | Cheng | |
| 5,361,241 | A | 11/1994 | Ferrara et al. | |
| 5,686,882 | A | 11/1997 | Giani | |
| 5,686,884 | A * | 11/1997 | Larkin et al. | 340/506 |
| D406,067 | S | 2/1999 | Bouban | |
| 6,081,949 | A * | 7/2000 | Delicia | 5/639 |
| 6,236,621 | B1 * | 5/2001 | Schettino | 368/10 |
| 6,377,177 | B1 * | 4/2002 | Broussard et al. | 340/573.1 |
| D492,204 | S * | 6/2004 | Clevenger | D10/2 |
| 7,027,358 | B1 * | 4/2006 | Esposito et al. | 368/10 |
| 7,106,662 | B1 * | 9/2006 | Acker, Jr. | 368/73 |
| 7,170,397 | B2 | 1/2007 | Roby et al. | |
| 7,283,427 | B1 * | 10/2007 | Stevens | 368/12 |
| 7,391,330 | B1 | 6/2008 | Brown | |
| 7,461,421 | B1 * | 12/2008 | Faircloth et al. | 5/639 |
| 7,461,422 | B1 | 12/2008 | Baker | |
| 8,184,846 | B1 * | 5/2012 | Craine | 381/388 |
| 2007/0253591 | A1 * | 11/2007 | Popilek et al. | 381/388 |
| 2007/0290817 | A1 * | 12/2007 | Huang | 340/309.16 |

* cited by examiner

*Primary Examiner* — Sean Kayes

(57) ABSTRACT

A vibratory alarm assembly includes a cover that may be positioned on a mattress. A vibrator pocket is coupled to the cover. A controller pocket coupled to the cover. A vibrating member is positionable within the vibrator pocket. A controller is positionable within the controller pocket. The controller has a housing. The controller is operationally coupled to the vibrating member. A processor is coupled to the housing. An alarm is coupled to the housing. The alarm is operationally coupled to the processor. A microphone is coupled to the housing. The microphone is operationally coupled to the processor. A power supply is coupled to the housing.

17 Claims, 5 Drawing Sheets

VIBRATORY ALARM ASSEMBLY

BACKGROUND OF THE DISCLOSURE

Field of the Disclosure

The disclosure relates to vibratory alarm devices and more particularly pertains to a new vibratory alarm device for waking a user without audible sound.

SUMMARY OF THE DISCLOSURE

An embodiment of the disclosure meets the needs presented above by generally comprising a cover that may be positioned on a mattress. A vibrator pocket is coupled to the cover. A controller pocket coupled to the cover. A vibrating member is positionable within the vibrator pocket. A controller is positionable within the controller pocket. The controller has a housing. The controller is operationally coupled to the vibrating member. A processor is coupled to the housing. An alarm is coupled to the housing. The alarm is operationally coupled to the processor. A microphone is coupled to the housing. The microphone is operationally coupled to the processor. A power supply is coupled to the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
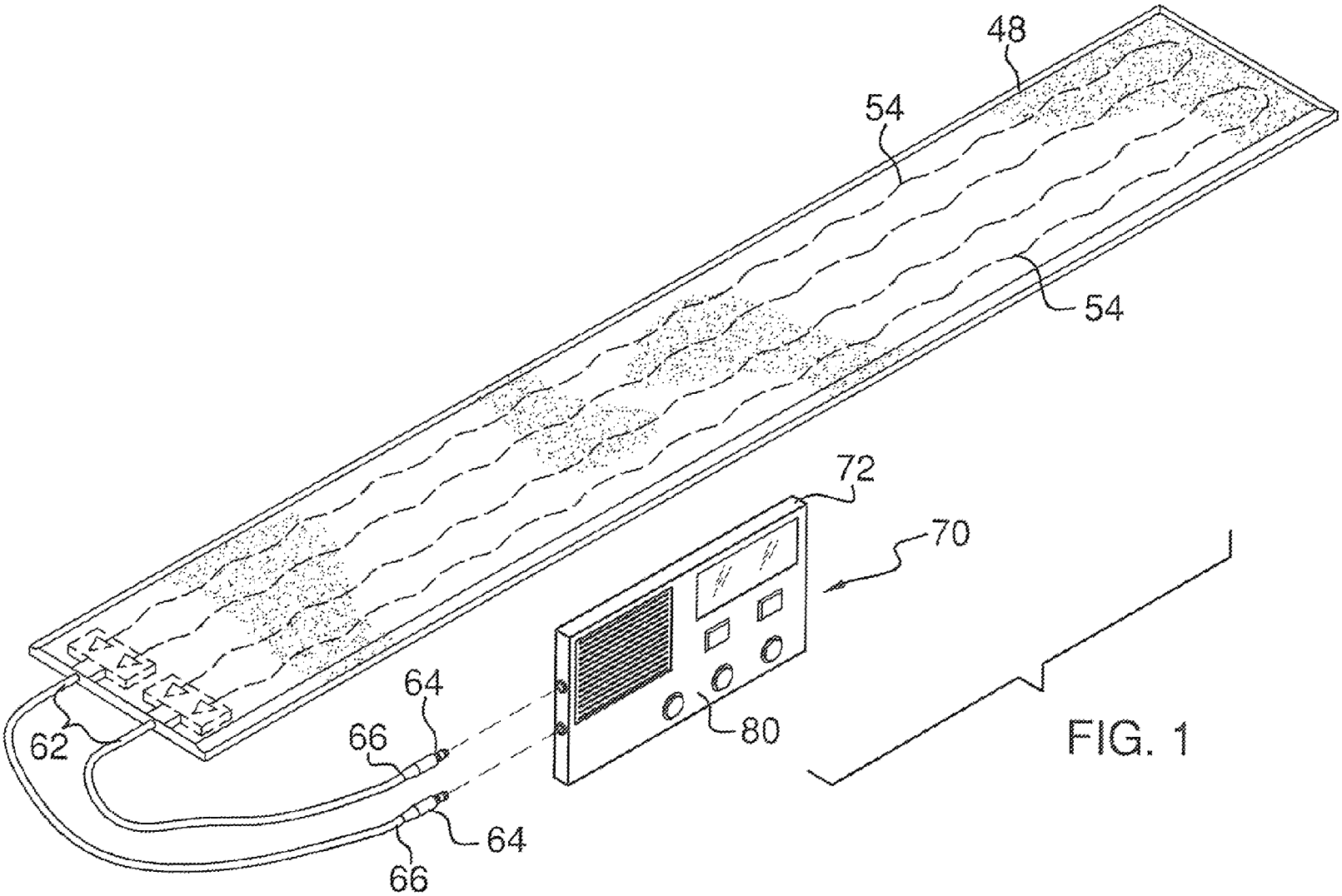
FIG. 1 is a perspective view of a vibratory alarm assembly according to an embodiment of the disclosure.
Figure 2:
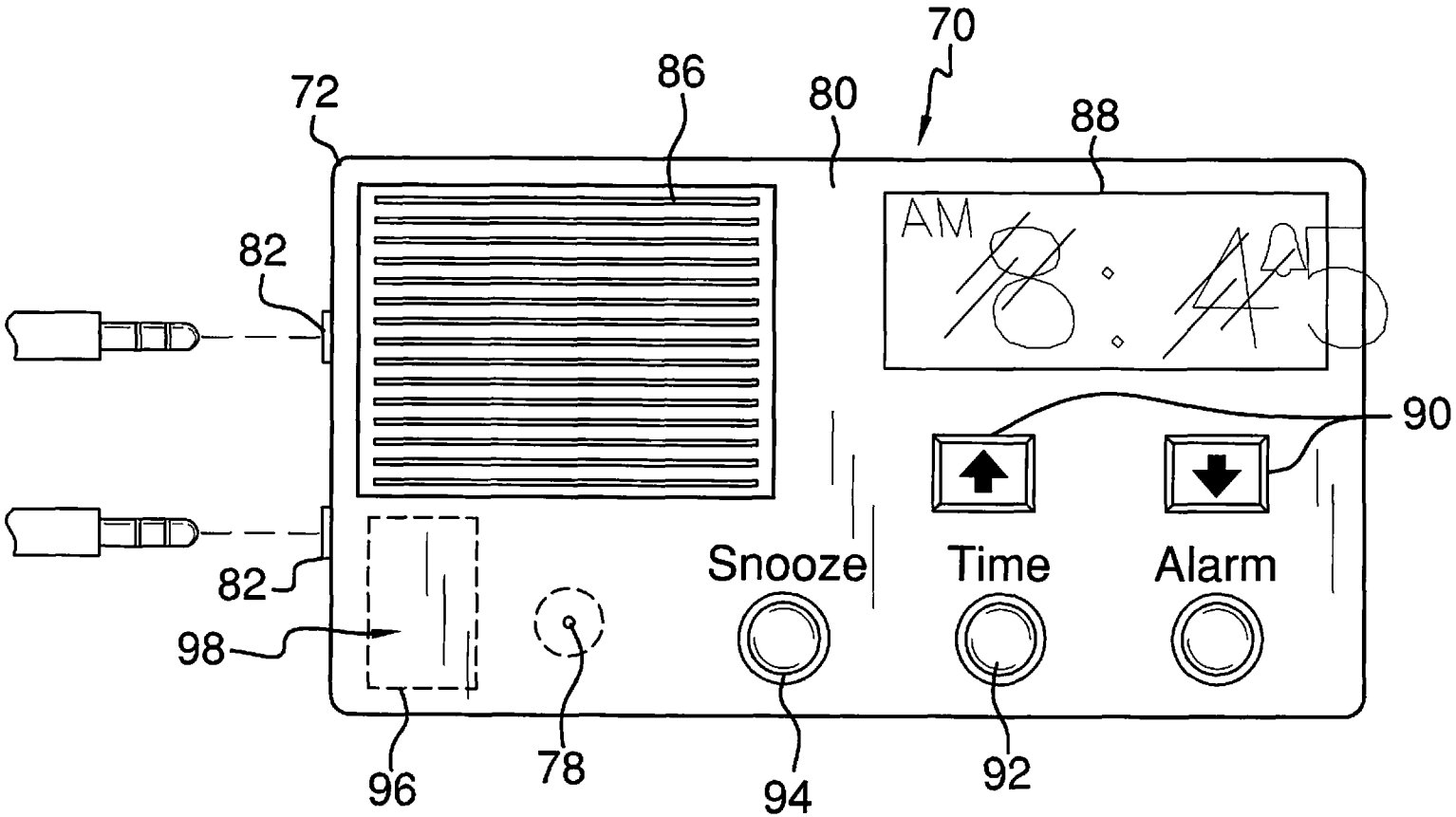
FIG. 2 is a front view of an embodiment of the disclosure.
Figure 3:
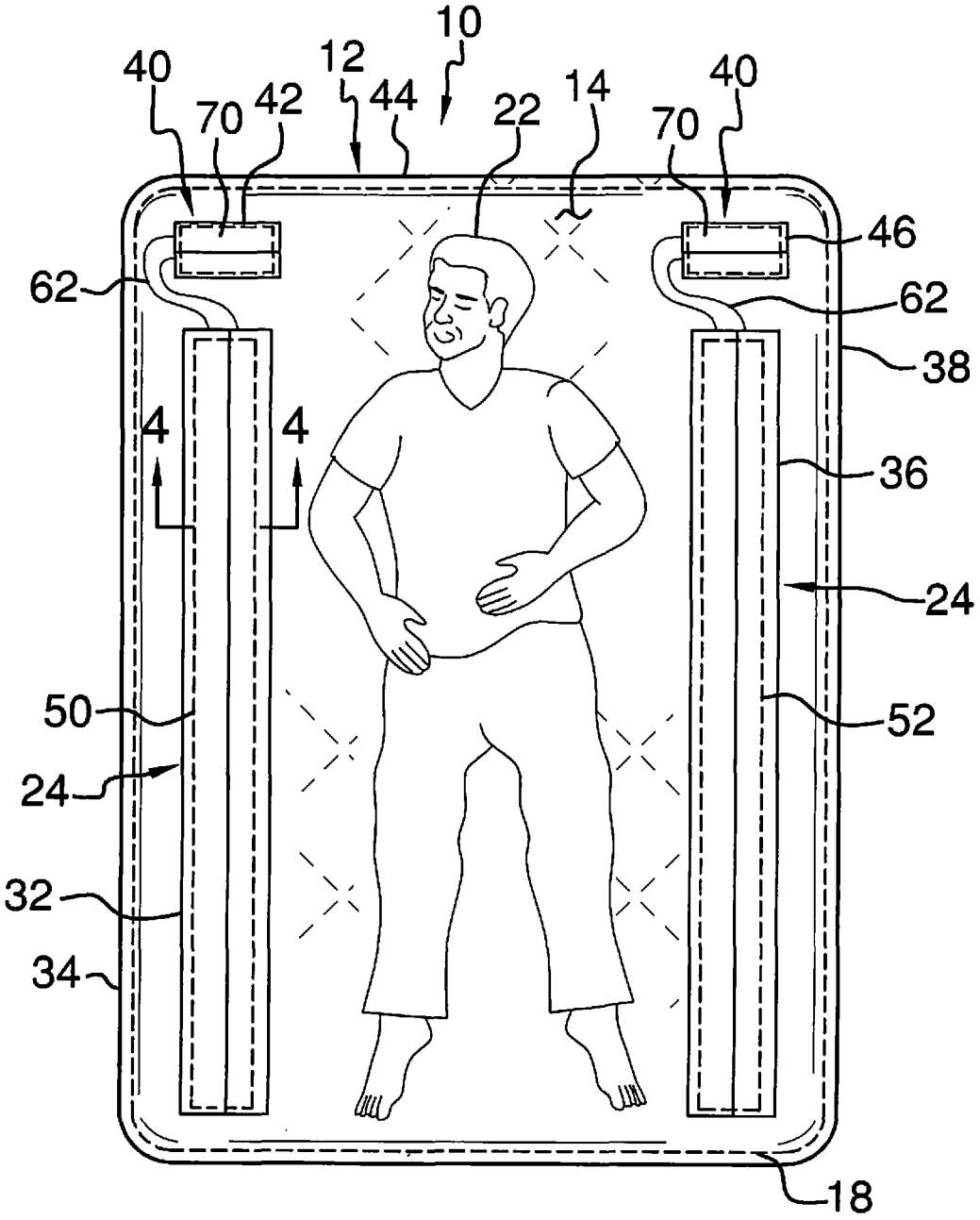
FIG. 3 is a top view of an embodiment of the disclosure.
Figure 4:
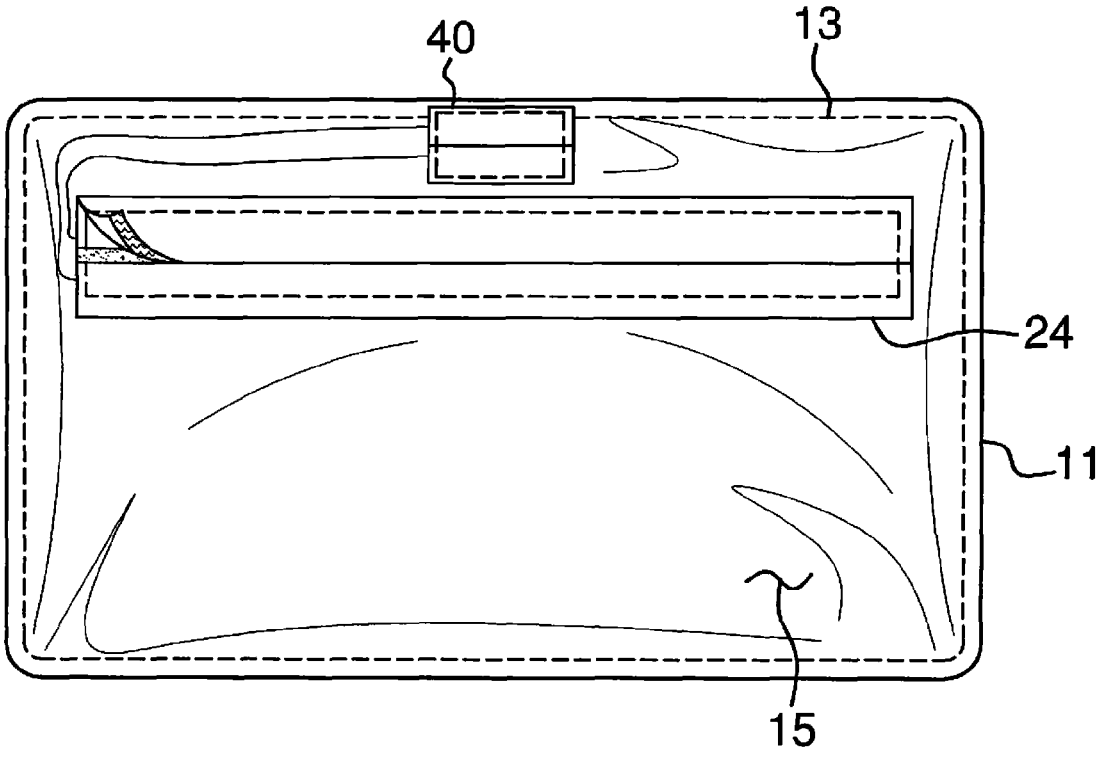
FIG. 4 is a bottom view of an embodiment of the disclosure.
Figure 5:
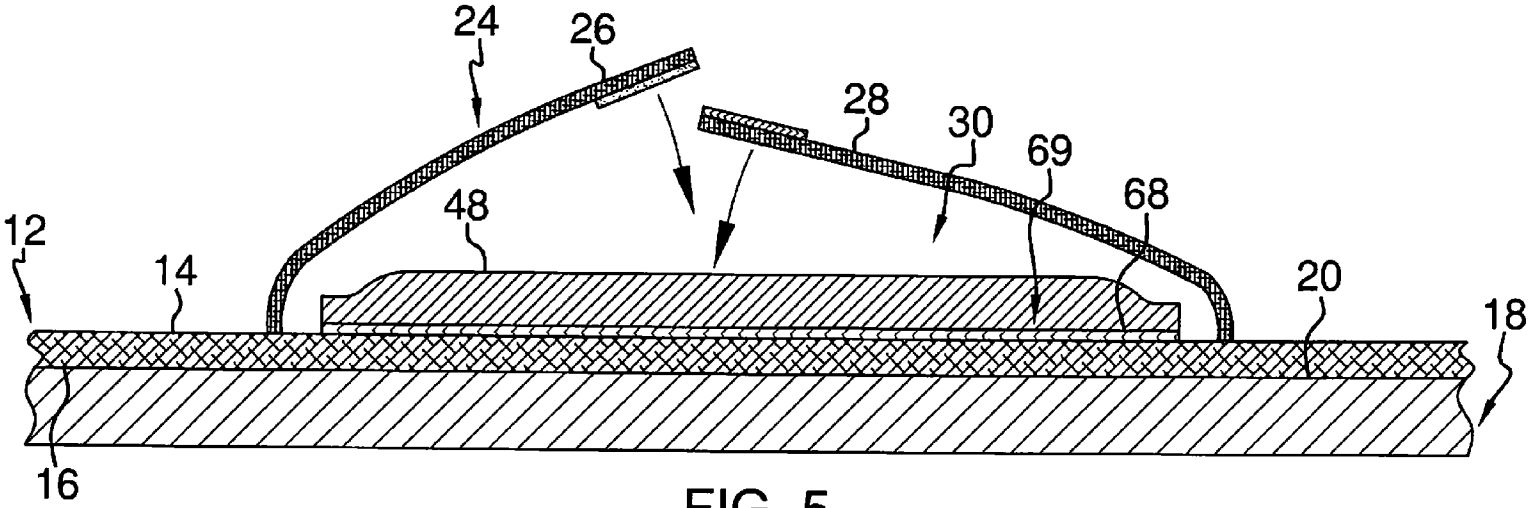
FIG. 5 is a cross sectional view taken along line 5-5 of FIG. 3 of an embodiment of the disclosure.
Figure 6:
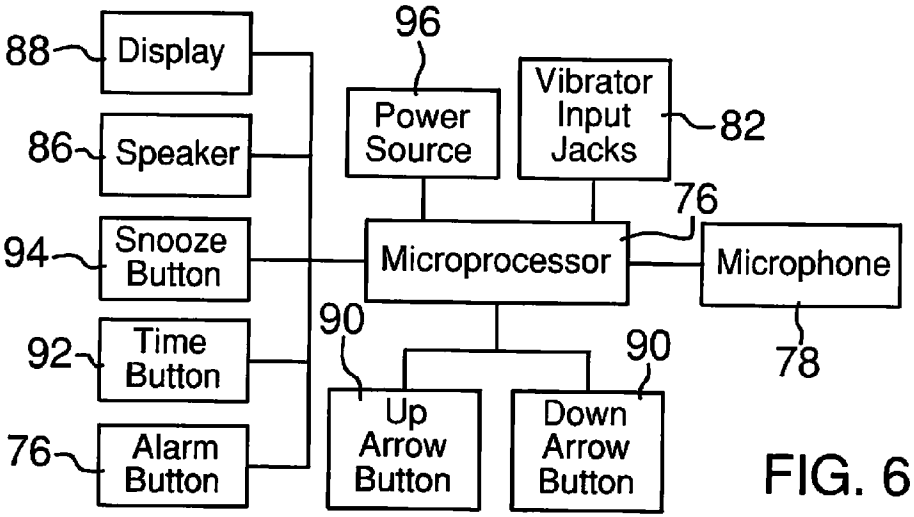
FIG. 6 is a schematic view of an embodiment of the disclosure.

With reference now to the drawings, and in particular to FIGS. 1 through 6 thereof, a new vibratory alarm device embodying the principles and concepts of an embodiment of the disclosure and generally designated by the reference numeral 10 will be described.

As best illustrated in FIGS. 1 through 6, the vibratory alarm assembly 10 generally comprises a cover 12 that has a top surface 14 and a bottom surface 16. The cover 12 is positionable on a mattress 18 such that the bottom surface 16 abuts a top 20 of the mattress 18 so the cover 12 may have a user 22 lay upon the top surface 14 of the cover 12. The bottom surface 16 of the cover 12 is coextensive with the top 20 of the mattress 18 so the cover 12 may completely cover the top 20 of the mattress 18. The cover 12 may be comprised of a deformable material such as cotton or other similar material.

A vibrator pocket 24 is coupled to the cover 12. The vibrator pocket 24 has a first flap 26 and a second flap 28. The first flap 26 is engageable to the second flap 28 covering an opening 30 into the vibrator pocket 24. The vibrator pocket 24 is one of a pair of vibrator pockets 24. A first one 32 of the vibrator pockets 24 is coupled to the top surface 14 of the cover 12 such that the first vibrator pocket 32 is positioned adjacent to and coextensive with a first lateral edge 34 of the cover 12. A second one 36 of the vibrator pockets 24 is coupled to the top surface 14 of the cover 12 such that the second vibrator pocket 36 is positioned adjacent to and coextensive with a second lateral edge 38 of the cover 12. Each of the vibrator pockets 24 may have a width between 7.5 cm and 12.5 cm. Each of the vibrator pockets 24 may have a length that is between 15 cm to 25 cm less than a length of the cover.

A controller pocket 40 is one of a pair of controller pockets 40. A first one 42 of the controller pockets 40 is coupled to the top surface 14 of the cover 12 such that the first controller pocket 42 is positioned between the first vibrator pocket 24 and a top edge 44 of the cover 12. A second one 46 of the controller pockets 40 is coupled to the top surface 14 of the cover 12 such that the second controller pocket 46 is positioned between the second vibrator pocket 36 and the top edge 44 of the cover 12. Each of the first 42 and second 46 controller pockets 40 may have a length between 10 cm and 15 cm. Each of the first 42 and second 46 controller pockets may have a width between 7.5 cm and 10 cm.

A vibrating member 48 is positionable within the vibrator pocket 24. Each of the first 26 and second 28 flaps may be positioned over the vibrating member 48 after the vibrating member 48 is positioned within the vibrating pocket 24 such that the first 26 and second 28 flaps cover the vibrating member 48. The first 26 and second 28 flaps may retain the vibrating member 48 within the vibrator pocket 24. The vibrating member 48 may have a width between 5 cm and 10 cm. The vibrating member 48 may be comprised of a flexible and resiliently compressible material. The vibrating member 48 is one of a pair of vibrating members 48. A first one 50 of the vibrating members 48 is positionable within and is coextensive with the first vibrator pocket 32. A second one 52 of the vibrating members 48 is positionable within and is coextensive with the second vibrator pocket 36.

A vibrator 54 is positioned within and extends between a first 56 and second 58 end of the vibrating member 48. The vibrator 54 forms a plurality of spaced loops 60 within the vibrating member 54. The vibrator 54 receives an electrical current so the vibrator 54 may vibrate the vibrating member 54. The vibrator 54 is one of a pair of vibrators 54. A conductor 62 is electrically coupled to and extends away from the vibrator 54. The conductor 62 delivers the electrical current to the vibrator 54. A plug 64 is electrically coupled to a free end 66 of the conductor 62. A coupler 68 is coupled to a bottom 70 of the vibrating member 54. The coupler 68 frictionally engages the vibrator pocket 24 so the vibrating member 54 is selectively retained in the vibrator pocket 24. The coupler 68 may comprise a hook and loop fastener 69.

A controller 70 is positionable within the controller pocket 40. The controller 70 has a housing 72. The controller 70 is operationally coupled to the vibrating member 48. The controller 70 includes a processor 74 coupled to the housing 72. The processor 74 may be positioned within the housing 72. The processor 74 actuates the vibrator 54 at a selected time of day. An alarm 76 is coupled to the housing 72. The alarm 76 may be positioned within the housing 72. The alarm 76 is electrically coupled to the processor 74. The alarm 76 actuates the processor 74 at a selected time of day.

A microphone 78 is coupled to the housing 72. The microphone 78 may be positioned on a front wall 80 of the housing 72. The microphone 78 is electrically coupled to the processor 74. The microphone 78 receives voice commands from the user 22 so the microphone 78 may actuate the processor 74. A pair of jacks 82 is coupled to the housing 72. The jacks 82 may be positioned on a lateral wall 84 of the housing 72. Each of the jacks 82 is electrically coupled to the processor 74. Each of the jacks 82 insertably receives the plug 64 so the processor 74 supplies an electrical current to the conductor 62 when the processor 74 is actuated.

A speaker 86 is coupled to the housing 72. The speaker 86 may be positioned on the front wall 80 of the housing 72. The speaker 86 is electrically coupled to the alarm 76. The speaker 86 emits an audible alarm when the alarm 76 reaches a selected time of day.

A display 88 is coupled to the housing 72. The display 88 may be positioned on the front wall 80 of the housing 72. The display 88 is electrically coupled to the alarm 76. The display 88 displays a time of day. The display 88 may be an LCD display of any conventional design. A pair of time adjustment actuators 90 is coupled to the housing 72. Each of the time adjustment actuators 90 may be positioned on the front wall 80 of the housing 72. Each of the time adjustment actuators 90 is electrically coupled to the alarm 76 so the pair of time adjustment actuators 90 may input the selected time of day into the alarm 76.

A time actuator 92 is coupled to the housing 72. The time actuator 92 may be positioned on the front wall 80 of the housing 72. The time actuator 92 is electrically coupled to the alarm 76 so the time actuator 92 may enter a time of day into the alarm 76. A snooze actuator 94 is coupled to the housing 72. The snooze actuator 94 may be positioned on the front wall 80 of the housing 72. The snooze actuator 94 is electrically coupled to the alarm 76 so the snooze actuator 94 may cause the alarm 76 to de-actuate the processor 74 for a selected duration of time. A power supply 96 is coupled to the housing 72. The power supply 96 may be positioned within the housing 72. The power supply 96 is electrically coupled to the processor 74. The power supply 96 comprises at least one battery 98.

The assembly 10 may be alternatively comprise a pillow case 11 of any conventional design configured insertably receive a pillow 13. The pillow case 11 may have the vibrator pocket 24 coupled to an outer surface 15 of the pillow 13 and the controller pocket 40 may be coupled to the outer surface 15 of the pillow 13. The vibrating member 48 and the controller 70 may each be positioned within an associated one of the vibrator pocket 24 and controller pocket 40. The vibrating member 48 and the controller 70 may be operationally coupled together in the previously described manner.

In use, the user 22 may set the alarm 76 to trigger the processor 74 at the selected time. The processor 74 may actuate the vibrator 54 at the selected time so the vibrating member 48 provides a vibration to wake the user 22 at the selected time. The user 22 may issue a voice command that the microphone 78 may transmit to the processor 74 so the processor 74 de-actuates the vibrator 54. The user 22 may actuate the snooze actuator 94 so the processor 74 may de-actuate the vibrator 54 in order that the processor 74 may actuate the vibrator 54 again at a predetermined amount of time after the snooze actuator 94 is actuated. The speaker 86 may emit an audible alarm in conjunction with the actuation of the vibrator 54 at the predetermined time. The speaker 86 may be used in conjunction with or independently of the vibrator 54.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A vibratory alarm assembly configured to be coupled to a mattress, said assembly comprising:

a cover, said cover being configured for positioning on said mattress;

a vibrator pocket coupled to said cover;

a controller pocket coupled to said cover;

a vibrating member being positionable within said vibrator pocket;

a controller being positionable within said controller pocket, said controller having a housing, said controller being operationally coupled to said vibrating member, a processor coupled to said housing;

an alarm coupled to said housing, said alarm being operationally coupled to said processor;

a microphone coupled to said housing, said microphone being operationally coupled to said processor; and a power supply coupled to said housing.

2. The assembly according to claim 1, further including said cover having a top surface and a bottom surface, said cover being positionable on said mattress such that said bottom surface abuts a top of said mattress whereby said cover is configured to have a user lay upon said top surface of said cover.

3. The assembly according to claim 2, further including said bottom surface of said cover being coextensive with the top of said mattress whereby said cover is configured to completely cover the top of said mattress.

4. The assembly according to claim 1, further including said vibrator pocket having a first flap and a second flap, said first flap being engageable to said second flap covering an opening into said vibrator pocket.

5. The assembly according to claim 1, further including a coupler coupled to a bottom of said vibrating member, said coupler frictionally engaging said vibrator pocket whereby said vibrating member is selectively retained in said vibrator pocket.

6. The assembly according to claim 4, further including each of said first and second flaps being positioned over said vibrating member after said vibrating member is positioned within said pocket such that said first and second flaps cover said vibrating member whereby said first and second flaps are configured to retain said vibrating member within said vibrator pocket.

7. The assembly according to claim 1, further including said vibrator pocket being one of a pair of vibrator pockets, a first one of said vibrator pockets being coupled to a top surface of said cover such that said first vibrator pocket is positioned adjacent to and coextensive with a first lateral edge of said cover, a second one of said vibrator pockets being coupled to said top surface of said cover such that said second vibrator pocket is positioned adjacent to and coextensive with a second lateral edge of said cover.

8. The assembly according to claim 7, further including said vibrating member being one of a pair of vibrating members, a first one of said vibrating members being positionable within and being coextensive with said first vibrator pocket, a second one of said vibrating members being positionable within and being coextensive with said second vibrator pocket.

9. The assembly according to claim 1, further including a vibrator positioned within and extending between a first and second end of said vibrating member, said vibrator forming a plurality of spaced loops within said vibrating member.

10. The assembly according to claim 9, further including said vibrator receiving an electrical current whereby said vibrator vibrates said vibrating member.

11. The assembly according to claim 10, further including a conductor electrically coupled to and extending away from said vibrator, said conductor delivering the electrical current to said vibrator.

12. The assembly according to claim 11, further including a plug electrically coupled to a free end of said conductor.

13. The assembly according to claim 9, further including said vibrator being one of a pair of vibrators.

14. The assembly according to claim 1, further comprising:

a first one of said vibrator pockets being coupled to a top surface of said cover;

a second one of said vibrator pockets being coupled to said top surface of said cover; and said controller pocket being one of a pair of controller pockets, a first one of said controller pockets being coupled to said top surface of said cover such that said first controller pocket is positioned between said first vibrator pocket and a top edge of said cover, a second one of said controller pockets being coupled to said top surface of said cover such that said second controller pocket is positioned between said second vibrator pocket and said top edge of said cover.

15. The assembly according to claim 1, further comprising:

said processor actuating said vibrator at a selected time of day;

said alarm being electrically coupled to said processor, said alarm actuating said processor at a selected time of day;

said microphone being electrically coupled to said processor, said microphone receiving voice commands from the user whereby said microphone is configured to actuate said processor; and said power supply being electrically coupled to said processor, said power supply comprising at least one battery.

16. The assembly according to claim 1, further comprising:

a vibrator positioned within and extending between a first and second end of said vibrating member;

a conductor electrically coupled to and extending away from said vibrator;

a plug electrically coupled to a free end of said conductor;

said controller including;

a pair of jacks coupled to said housing, each of said jacks being electrically coupled to said processor, each of said jacks insertably receiving said plug whereby said processor supplies an electrical current to said conductor when said processor is actuated;

a speaker coupled to said housing, said speaker being electrically coupled to said alarm, said speaker emitting an audible alarm when said alarm reaches a selected time of day;

a display coupled to said housing, said display being electrically coupled to said alarm, said display displaying a time of day;

a pair of time adjustment actuators coupled to said housing, each of said time adjustment actuators being electrically coupled to said alarm whereby said pair of time adjustment actuators are configured to input the selected time of day into said alarm;

a time actuator coupled to said housing, said time actuator being electrically coupled to said alarm whereby said time actuator is configured to enter a time of day into said alarm; and a snooze actuator coupled to said housing, said snooze actuator being electrically coupled to said alarm whereby said snooze actuator is configured to cause said alarm to de-actuate said processor for a selected duration of time.

17. A vibratory alarm assembly configured to be coupled to a mattress, said assembly comprising:

a cover having a top surface and a bottom surface, said cover being positionable on a mattress such that said bottom surface abuts a top of said mattress whereby said cover is configured to have a user lay upon said top surface of said cover, said bottom surface of said cover being coextensive with the top of said mattress whereby said cover is configured to completely cover the top of said mattress;

a vibrator pocket coupled to said cover, said vibrator pocket having a first flap and a second flap, said first flap being engageable to said second flap covering an opening into said vibrator pocket, said vibrator pocket being one of a pair of vibrator pockets, a first one of said vibrator pockets being coupled to said top surface of said cover such that said first vibrator pocket is positioned adjacent to and coextensive with a first lateral edge of said cover, a second one of said vibrator pockets being coupled to said top surface of said cover such that said second vibrator pocket is positioned adjacent to and coextensive with a second lateral edge of said cover;

a controller pocket being one of a pair of controller pockets, a first one of said controller pockets being coupled to said top surface of said cover such that said first controller pocket is positioned between said first vibrator pocket and a top edge of said cover, a second one of said controller pockets being coupled to said top surface of said cover such that said second controller pocket is positioned between said second vibrator pocket and said top edge of said cover;

a vibrating member positionable within said vibrator pocket, each of said first and second flaps being positioned over said vibrating member after said vibrating member is positioned within said vibrating pocket such that said first and second flaps cover said vibrating member whereby said first and second flaps are configured to retain said vibrating member within said vibrator pocket, said vibrating member being one of a pair of vibrating members, a first one of said vibrating members being positionable within and being coextensive with said first vibrator pocket, a second one of said vibrating members being positionable within and being coextensive with said second vibrator pocket;

a vibrator positioned within and extending between a first and second end of said vibrating member, said vibrator forming a plurality of spaced loops within said vibrating member, said vibrator receiving an electrical current whereby said vibrator is configured to vibrate, whereby said vibrator is configured to vibrate said vibrating member, said vibrator being one of a pair of vibrators;

a conductor electrically coupled to and extending away from said vibrator, said conductor delivering the electrical current to said vibrator;

a plug electrically coupled to a free end of said conductor;

a coupler coupled to a bottom of said vibrating member, said coupler frictionally engaging said vibrator pocket whereby said vibrating member is selectively retained in said vibrator pocket;

a controller being positionable within said controller pocket, said controller having a housing, said controller being operationally coupled to said vibrating member, said controller including;

a processor coupled to said housing, said processor actuating said vibrator at a selected time of day;

an alarm coupled to said housing, said alarm being electrically coupled to said processor, said alarm actuating said processor at a selected time of day;

a microphone coupled to said housing, said microphone being electrically coupled to said processor, said microphone receiving voice commands from the user whereby said microphone is configured to actuate said processor;

a pair of jacks coupled to said housing, each of said jacks being electrically coupled to said processor, each of said jacks insertably receiving said plug whereby said processor supplies an electrical current to said conductor when said processor is actuated;

a speaker coupled to said housing, said speaker being electrically coupled to said alarm, said speaker emitting an audible alarm when said alarm reaches a selected time of day;

a display coupled to said housing, said display being electrically coupled to said alarm, said display displaying a time of day;

a pair of time adjustment actuators coupled to said housing, each of said time adjustment actuators being electrically coupled to said alarm whereby said pair of time adjustment actuators are configured to input the selected time of day into said alarm;

a time actuator coupled to said housing, said time actuator being electrically coupled to said alarm whereby said time actuator is configured to enter a time of day into said alarm;

a snooze actuator coupled to said housing, said snooze actuator being electrically coupled to said alarm whereby said snooze actuator is configured to cause said alarm to de-actuate said processor for a selected duration of time; and a power supply coupled to said housing, said power supply being electrically coupled to said processor, said power supply comprising at least one battery.

* * * * *